US005482741A

United States Patent [19]

Law et al.

[11] Patent Number: 5,482,741

[45] Date of Patent: Jan. 9, 1996

[54] SURFACE-TREATED CHARGE CONTROL AGENTS, AND METHOD FOR PRODUCING THE SAME

[75] Inventors: Kock-Yee Law, Penfield; Ihor W. Tarnawskyj, Webster, both of N.Y.

[73] Assignee: Xerox Corporation, Stamford, Conn.

[21] Appl. No.: 268,550

[22] Filed: Jul. 6, 1994

[51] Int. Cl.[6] ..... B05D 7/00

[52] U.S. Cl. ..... 427/215; 427/355; 427/372.2

[58] Field of Search ..... 427/215, 372.2, 427/355; 430/110

[56] References Cited

U.S. PATENT DOCUMENTS 4,734,350 3/1988 Lin et al. ..... 430/110
4,965,158 10/1990 Gruber et al. ..... 430/110
5,256,514 10/1993 Law et al. ..... 430/110
5,256,515 10/1993 Law et al. ..... 430/110
5,300,389 4/1994 Law et al. ..... 430/110
5,346,795 9/1994 Pickering et al. ..... 430/110

*Primary Examiner*—Shrive Beck
*Assistant Examiner*—David M. Maiorana
*Attorney, Agent, or Firm*—Oliff & Berridge

[57] ABSTRACT

A composition, for use in such applications as electrostatographic toners and developers, containing a charge control agent adsorbed onto flow aid particles may be produced by a solution coating process including: (1) dissolving the charge control agent in at least one solvent; (2) adding the flow aid particles to the solvent and forming a suspension; (3) removing the solvent from the suspension after adsorption of the charge control agent onto the flow aid particles has occurred; and (4) drying and milling the material remaining after the solvent is removed from the suspension.

11 Claims, No Drawings

SURFACE-TREATED CHARGE CONTROL AGENTS, AND METHOD FOR PRODUCING THE SAME

BACKGROUND OF THE INVENTION

This invention relates to improved surface-treated charge control agent compositions, and a process for producing such compositions. The process is particularly useful in the production of charge control agents and other external additives for use in electrophotographic toner and developer compositions. The present invention also relates to such surface-treated charge control agent compositions produced by an adsorption process.

The surface-treated charge control agent compositions produced by the adsorption process may be utilized for making electrophotographic toners and developers according to conventional methods. Such toners and developers may then be used in conventional electrophotographic imaging processes.

Combinations of charge control agents and flow aid particles and methods for producing such combinations are known in the art.

Charge control agents may be produced and coated onto flow aid particles by a variety of different methods. Such methods include solution coating and vapor phase reaction.

For example, U.S. Pat. Nos. 5,256,514, 5,256,515 and 5,300,389, all to Law et al., the disclosures of which are incorporated herein by reference, disclose halogenated salicylic acid charge enhancing additives. The disclosed charge enhancing additives may be incorporated into the toner or the additives may be present on the toner surface or coated onto toner additives such as colloidal silica. Where the charge enhancing additives are coated onto toner additives such as colloidal silica, such coating is conducted using the conventional solution coating or vapor phase reaction processes. Toner compositions incorporating the disclosed charge enhancing additives may be triboelectrically charged to a value of between −10 and −50 μC/g.

U.S. Pat. No. 4,734,350 to Lin et al. discloses modified charge enhancing additives which are chemically bonded to or chemisorbed onto flow aid particles such as silica particles. In one embodiment, an amine or amino alcohol is reacted with the flow aid particles by heating a solution of the components. In another embodiment, the charge additive is prepared by a series of reactions between the flow aid particles with a silylating material and an amine. These processes are, however, different from the adsorption process of the present invention. Lin discloses that the charge enhancing additives are themselves chemically modified, and are chemically bonded to or chemisorbed onto the surface of the flow aid particles. By chemisorbed is meant that the charge enhancing additive participates in a chemical interaction with the flow aid particle. Thus chemical bonding and chemisorption (or chemical adsorption) are distinct from the adsorption of the present invention, wherein the charge enhancing additive is adhered to the surface of the flow aid particles by a relatively small attractive force, such as by van der Waals forces, rather than by being chemically altered and attached to the flow aid particles.

The focus in the toner/developer community has been to coat charge control agents onto flow aid particles using a solution coating process followed by a fluidized bed spray drying process to produce homogeneous or inhomogeneous mixtures of the charge control agent and the flow aid particles. This process is effective in producing good quality charge control agents, and can be scaled up for industrial applications. A problem with such conventional processes is that they produce charge control agents that possess several disadvantageous properties. Specifically, the admix time for such conventional charge control agents may be lengthy, and the triboelectric charging characteristics of the particles are not as high as would be desired for toner and developer applications.

SUMMARY OF THE INVENTION

The need continues to exist in the toner/developer community for improved charge control agents, specifically those with a shorter admix time and higher triboelectric charging characteristics. We have discovered that an adsorption process, rather than the conventional solution coating process, provides such improved admix time and triboelectric charging characteristics. Such improved charge control agents, and a process for producing such compositions, are provided herein.

Specifically, this invention provides a process for preparing a charge control agent composition comprising adsorbing a charge control agent onto a flow aid particle.

The charge control agent compositions of the present invention are particularly useful in toners and developers for use in electrophotographic imaging systems. The charge control agents of the present invention provide both shorter admix time and better triboelectric charging characteristics. Furthermore, the adsorption process of the present invention may be applied to coating charge control agents, as well as other compounds, onto flow aid particles to form other external toner additives.

DETAILED DESCRIPTION OF PREFERRED EMBODIMENTS

The adsorption process of the present invention may be carried out, for example, by an improved process of solution coating a charge control agent onto the surface of an appropriate flow aid particle. Proper selection of the charge control agent, flow aid particle and solvent results in the charge control agent being adsorbed onto the surface of the flow aid particle, rather than producing a simple particulate mixture of the charge control agent and flow aid particles. Preferably, the charge control agent is molecularly adsorbed onto the surface of the flow aid particle.

The flow aid particles which may be used in the present invention may include any such particles that are suitable for use in producing charge control agents and other external toner additives. Such particles are known in the art. Examples of such particles suitable for use in the present invention include, but are not limited to, silica compositions, titanium dioxide, aluminum oxide, tin oxide and magnesium oxide particles. For example, Aerosil R972, which is a hydrophobic amorphous fumed silica available from Degussa, is particularly useful in the present invention.

Various known suitable effective positive or negative charge control agents can be selected for use in the present invention. Examples include 3,5-ditertbutylsalicylic acid, potassium bis(3-,5-ditertbutylsalicylato)borate, potassium tetraphenylborate, Bontron E88 and Bontron E84 (Orient Chemicals), lithium 3,5-di-t-butylsalicylate, sodium 3,5-di-t-butylsalicylate, potassium 3,5-di-t-butylsalicylate, 3,5-di-iodosalicylic acid, 3,5-di-bromosalicylic acid, lithium 3,5-di-iodosalicylate, lithium 3,5-di-bromosalicylate, tris(3,5-di-iodosalicylato)aluminum, tris( 3,5-di-bromosalicylato)aluminum, bis(3,5-di-iodosalicylato)zinc, bis(3,5 -di-bromosalicylato)zinc, potassium bis(3,5-di-iodosalicylato)borate, potassium bis(3,5-di-bromosalicylato)borate, mixtures thereof and the like.

Any of various known organic or inorganic solvents may be utilized in the present invention. Proper selection of the solvent is important, and is based upon the increased solubility characteristics of the specific charge control agent in the solvent. Selection of the solvent governs the partitioning of the charge control agent between the solution phase and adsorption onto the flow aid particle surface, and also influences the precipitation and/or crystallization of the charge control agent when the solvent is removed. For example, if the charge control agent is highly soluble in the selected solvent, a higher proportion of the charge control agent will remain dissolved in the solvent and is more likely to precipitate out of solution in the form of a powder mixture with the flow aid particles when the solvent is removed, rather than being adsorbed onto the surface of the flow aid particles. It is therefore desired to select a solvent for the specific charge control agent such that the charge control agent has a strong tendency to be adsorbed on the surface of the flow aid particles when the flow aid particles are added to the coating solution, rather than remaining dissolved in the solvent.

In selecting the solvent for adsorbing the charge control agent onto a particle, it is essential that the charge control agent be soluble in the solution. This is the essence of the conventional solution coating process. However, the adsorption process of the present invention also requires that the charge control agent be adsorbed onto the surface of the flow aid particle. Thus, although the charge control agent is soluble in the selected solvent, the present invention provides that the solvent be selected such that the charge control agent is preferentially forced onto the surface of the flow aid particle and adsorbed thereon, rather than remaining in solution. The particular solvent for the adsorption process is selected such that the interaction between the charge control agent and the flow aid particle is stronger than the solution interaction (solvation) between the charge control agent and the solvent.

Preferred solvents for use in the adsorption process of the present invention are those which have a retention time of close to zero in silica gel thin layer chromatography (TLC). Silica gel TLC is used because the silica gel is similar in properties to the silica particle surface of the preferred flow aid particles. When a solution of the particular charge control agent and solvent is subjected to the silica gel TLC, the tendency of the charge control agent to remain dissolved in the solvent versus the tendency of the charge control agent to be adsorbed on the silica surface may be demonstrated. In the case where the charge control agent remains dissolved in the solvent, rather than being adsorbed on the silica surface, the solvent carries the soluble charge control agent to the top of the test plate, and the retention time is denoted as one. However, in the case where the charge control agent is preferentially adsorbed on the silica surface, rather than being carried along by the solution, the retention time is denoted as zero. Retention times of between zero and one indicate variations in the adsorption of the charge control agent on the silica surface versus the charge control agent remaining in solution and forming a particulate mixture with the silica when the solvent is removed. Therefore, in the adsorption process of the present invention, it is desired that the solvent have a retention time of close to zero. That is, the solvent should be selected such that the charge control agent is soluble therein, but at the same time the solvent should force the charge control agent to adsorb on the silica surface rather than remaining in solution with the solvent. The solvent or mixture of solvents used in the present invention preferably have a retention time of less than about 0.5, and more preferably less than about 0.2. Even more preferably, the retention time should be about zero.

The solvents used in the present invention may include, but are not limited to, such solvents as aliphatic hydrocarbons, aromatic hydrocarbons, chlorocarbons, ketones, acetates, ethers, cyclic ethers, alcohols, mixtures thereof and the like. Specific examples of such solvents include, but are not limited to, cyclohexane, benzene, methanol, chloroform, heptane, ethyl acetate, hexane, methylene chloride, acetone and mixtures thereof.

The charge control agent compositions of the present invention may, for example, be prepared by solution coating a charge control agent onto the surface of a flow aid particle, whereby the charge control agent is adsorbed onto the surface of the flow aid particle. Typically, from about one to one hundred parts of flow aid particles are present to each part of charge control agent. Preferably, the ratio of charge control agent to flow aid particles is one part charge control agent to twenty parts flow aid particles. "Parts," as used herein, refers to parts by weight.

A solution may first be made by dissolving the charge control agent in an appropriate amount of solvent. Such dissolution may be accomplished by stirring and/or heating, as appropriate, to effectively dissolve the charge control agent in the solvent. To the solution may then be added the flow aid particles, and a suspension is formed. Such suspension may be formed and maintained by stirring, as appropriate. The suspension of the flow aid particles in the solution is maintained for a time sufficient to ensure homogeneous adsorption of the charge control agent onto the surface of the flow aid particles.

After the adsorption is complete, the solvent may be removed from the suspension, for example by use of an evaporator or fluidized bed dryer. The residue thus obtained may be further processed, for example by milling and classification, to yield charge control agent compositions of appropriate size.

The charge control agent compositions of the present invention may be incorporated into conventional toner and developer compositions as an external additive according to known methods. Preferably, the charge control agent composition of the present invention is mixed with a toner in an amount of from about 0.05% to about 5% by weight, and more preferably from about 0.1% to about 3% by weight. However, one skilled in the art will recognize that the amount of charge control agent composition mixed with a specific toner may vary based upon the desired characteristics of the toner composition.

Resins are generally present in the toner in an amount of from about 40% to about 98% by weight, and more preferably from about 70% to about 98% by weight, although they may be present in greater or lesser amounts, provided that the objectives of the invention are achieved. Toner resins can be subsequently melt blended or otherwise mixed with a colorant, surfactants, emulsifiers, pigment dispersants, and the like. The resultant product can then be pulverized by known methods such as milling to form toner particles. The toner particles preferably have an average volume particle diameter of about 4 microns to about 30 microns, and more preferably about 4 microns to about 15 microns. External additives such as the charge control agent compositions or other flow aids may then be mixed with the toner.

Various suitable colorants can be employed in toners of the invention, including suitable colored pigments, dyes, and mixtures thereof including Carbon Black, such as Regal 330®carbon black (Cabot), Acetylene Black, Lamp Black and Aniline Black; Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably carbon black, cyan, magenta and/or yellow colorant, is incorporated in an amount sufficient to impart the desired color to the toner. In general, pigment or dye is employed in an amount ranging from about 2% to about 60% by weight, and preferably from about 2% to about 15% by weight for color toner and about 3% to about 20% by weight for black toner.

Additionally, other internal and/or external additives may be added to the toner compositions in known amounts for their known functions.

The resulting toner compositions optionally can be formulated into a developer composition by mixing with developer carrier particles. Illustrative examples of carrier particles that can be selected for mixing with the toner compositions prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference. In another embodiment the carrier particles may be selected so as to be of a positive polarity in order that toner particles which are negatively charged will adhere to and surround the carrier particles. Additionally, the polarity of the carrier particles may be adjusted by coating the carrier particles with known coating materials of the appropriate charge polarity.

The selected carrier particles can be used with or without a coating, the coating generally being comprised of fluoropolymers, such as polyvinylidene fluoride resins, terpolymers of styrene, methyl methacrylate and a silane, such as triethoxy silane, tetrafluoroethylenes, polymethyl methacrylate, other known coatings and the like. For example, the carrier particles may be coated with a polymethyl methacrylate carrier coating, additionally doped with carbon black from about 5% to about 30% by weight, to make the coated carrier particles conductive.

The diameter of the carrier particles is generally from about 50 microns to about 1,000 microns, preferably from about 65 to about 200 microns, thus allowing these particles to possess sufficient density and inertia to avoid adherence to the electrostatic images during the development process. The carrier particles can be mixed with the toner particles in various suitable combinations. However, best results are obtained when about 1 part toner to about 10 parts to about 200 parts by weight of carrier are mixed.

Toners and developers of the present invention can be used in known electrophotographic imaging methods. Thus, for example, the toners or developers of the present invention can be charged, e.g., triboelectrically, and applied to an oppositely charged latent image on an imaging member such as a photoreceptor or ionographic receiver. The resultant toner image can then be transferred, either directly or via an intermediate transport member, to a support such as paper or a transparency sheet. The toner image can then be fused to the support by application of heat and/or pressure, for example with a heated fuser roll.

As discussed above, the compositions of the present invention represent improvements and advantages over conventional products. For example, charge control agent compositions of the present invention exhibit higher triboelectric charging characteristics and shorter admix times compared to similar charge control agents prepared by the conventional solution coating process. Compositions of the present invention may carry a triboelectric charge 30% higher than the triboelectric charge of charge control agents made by such conventional methods.

Additionally, charge control agent compositions of the present invention possess an admix time which is significantly shorter than the admix time for charge control agents made by the conventional solution coating process. Here, the admix time denotes the amount of mixing time required for an amount of fresh toner added into the existing developer to become fully equilibrated in charge with the original developer. For example, charge control agent compositions of the present invention may possess an admix time of from 1/2 to 1/10, or even better, of the admix time of charge control agents made by such conventional methods.

Although there is no intention to limit the scope of the present invention as to a specific theory, it is believed that the higher triboelectric charging capacity and shorter admix times of the adsorbed charge control agents are due to a surface area effect. It is believed that the charge control agent, when adsorbed onto the surface of the flow aid particles, covers a much larger surface area of the flow aid particle. This increased surface area coverage thus results in a larger active area for the charge control agent when present in a toner or developer. The increased surface area thus allows a higher triboelectric charging value, and allows for rapid charging and/or more efficient direct charge exchange between charge control agent sites so as to reduce the admix time. Although preferred embodiments of the present invention are directed towards molecular adsorption of the charge control agents onto the surface of the flow aid particles, the above description applies equally to, and encompasses, the adsorption of aggregates of charge control agents onto the surface of the flow aid particles. In these and other embodiments, the charge control agent is adsorbed onto the flow aid particle, rather than forming a simple mixture with the flow aid particles.

One skilled in the art will recognize that the charge control agents and production method discussed above may be adjusted as necessary to achieve a toner or developer composition with specific characteristics. The invention will now be described in detail with reference to specific preferred embodiments thereof, it being understood that these examples are intended to be illustrative only, and the invention is not intended to be limited to the materials, conditions, process parameters, etc. recited herein. All parts and percentages are by weight unless otherwise indicated.

EXAMPLES

Example 1

A surface-treated charge control agent composition is prepared. A charge control agent solution is prepared by dissolving 0.3 g of 3,5-ditertbutylsalicylic acid (available from Yoshitomi) in approximately 100 mL of cyclohexane solvent in a 250 mL round bottom flask. After the dissolution, 3.0 g of Aerosil R972 (a hydrophobic amorphous fumed silica, available from Degussa) is added and the suspension is stirred for 30 minutes. The solvent is then removed in an evaporator. The residue obtained is transferred to a crystallization dish and is dried in an oven overnight at approximately 70° C. The solid residue is then transferred to a four ounce bottle and roll-milled with 35 g of ¼ inch steel shot for 30 minutes at a speed of approximately 90 ft/min, yielding approximately 3 g of a white powder. This white powder is the surface-treated Aerosil charge control agent composition.

The surface-treated Aerosil is then analyzed for its morphology, i.e., to determine whether the 3,5-di-tertbutylsalicylic acid is adsorbed on the Aerosil flow aid particles or is in the form of a fine particulate mixture with the flow aid particles. To determine the Aerosil morphology, scanning electron microscopy is conducted. Additionally, the microscopy findings are confirmed by use of fluorescence emission testing. The fluorescence spectra are taken on a Perkin-Elmer MPF-66 fluorescence spectrophotometer, which is interfaced with a computer, Perkin-Elmer Model 7700. As to the charge control agent composition of this example 1, the microscopy and fluorescence emission testing suggest that the charge control agent is adsorbed on the surface of the Aerosil.

Next, an experimental toner is prepared using the surface-treated Aerosil produced above. In a four ounce bottle are placed 0.063 g of the above surface-treated Aerosil, 12.5 g of 9 μm unpigmented styrene/butadiene (91/9) toner and 125 g of ¼ inch steel shot. The bottle is roll-milled for 30 minutes at a speed of approximately 90 ft/min, thus producing the experimental toner.

A developer is next prepared using the above experimental toner. The developer is prepared by mixing 1.25 g of the experimental toner and 60 g of carriers. Here, the carrier is made of an approximately 130 μm diameter steel core, coated with a polyvinylidene fluoride (Kynar®)/polymethyl methacrylate powder mixture at a weight loading of 0.7%. That is, the carrier particles are coated with 0.7% by weight of the coating powder mixture. The developer is conditioned at a relative humidity of 20±4% for at least 16 hours before evaluation.

The triboelectric charging capacity of the toner is obtained by roll-milling the developer for 60 minutes at a speed of 90 ft/min, and is evaluated using the standard blow-off procedure. The admix time is evaluated by adding 1% of the fresh toner into the developer, which has a toner concentration of 2%. The charge distribution of the final developer is recorded on a charge spectrograph apparatus as a function of time, e.g., 15 seconds, 30 seconds, one minute, two minutes, five minutes and fifteen minutes. This testing determines that the charge control agent composition of this example 1, where the relative humidity is 20% and the developer carrier coating has a polyvinylidene fluoride/polymethyl methacrylate ratio of 20:80, has a triboelectric charging capacity of −82.9 μC/g, and an admix time of two minutes.

The properties of the charge control agent, toner and developer compositions are summarized in Table I below.

Examples 2–4 and Comparative Examples 1–4

Charge control agent compositions, toners and developers are made as in Example 1, above, except that different solvents and charge control agents are used. The same production procedures are followed, the same material quantities are used, and the same testing is performed. However, fluorescence emission testing to confirm the physical state of the charge control agent composition is only conducted on compositions containing 3,5-di-tertbutylsalicylic acid.

The further examples and comparative examples use, as the charge control agents, potassium bis (3,5-di-tertbutylsalicylato)borate (tradename LR-120, available from Japan Carlit) and potassium tetraphenylborate (synthesized in the laboratory from sodium tetraphenylborate). The specific solvent and charge control agent for each example, and the test results, are summarized in Table I below.

Comparison of the results of Examples 1–5 with Comparative Examples 1–4 and 8 demonstrates the effect of the solubility of the charge control agent in the solvent upon the physical state of the final composition. As the solubility of the charge control agent increases, the final composition is more likely to be a fine mixture of charge control agent and flow aid particles, rather than the charge control agent adsorbed onto the surface of the flow aid particles. As demonstrated by these Examples, when the fine mixture exists, the admix time increases and the triboelectric charging capacity decreases as compared to the samples exhibiting adsorption of the charge control agent on the flow aid particles.

The charge control agent and solvent of each of Examples 1–3 and Comparative Examples 1–2 are analyzed using the silica gel thin layer chromatography method described above. The results are as follows, $R_f$ indicating the retention time:

| | |
|---|---|
| Example 1 | $R_f = 0$ |
| Example 2 | $R_f = 0.2$ |
| Example 3 | $R_f = 0$ |
| Comparative Example 1 | $R_f = 1$ |
| Comparative Example 2 | $R_f = 1$ |

In the case of Comparative Example 3, using LR 120 as the charge control agent and a mixture of heptane and acetone as the solvent, no retention time is determined because the LR120 precipitates as very fine particles before the silica particles are added.

Comparative Examples 5–7

Charge control agent compositions, toners and developers are made as in Comparative Examples 1–4, above, except that the charge control agent compositions are made according to the known solution coating process. The solution coating process proceeds according to Example 1, above, except that acetone is used as the solvent, and the resulting composition is dried using a fluidized bed spray process. The result of the process is a fine particulate mixture of the charge control agent and flow aid particles (in Comparative Examples 5 and 6) and an inhomogeneous mixture (Comparative Example 7). The properties of the charge control agent, toner and developer compositions are summarized in Table I below.

Example 5

A charge control agent composition, toner and developer are made as in Example 4, above. The toner composition of this Example 5 utilizes a polyester SPAR toner. A developer composition is made by mixing the toner composition with 130 μm steel carrier particles that are coated with 1% by weight of a polymethyl methacrylate that is doped with 20% by weight of carbon black. The same production procedures are followed, the same material quantities are used, and the same testing is performed. The test results are summarized in Table I below.

Comparative Example 8

A charge control agent composition is prepared as in Example 5, except that it is coated with acetone and dried in a fluidized bed process. Experimental toners and developers are prepared and tested as in Example 5. The test results are summarized in Table I below.

TABLE I

Properties of Surface-Treated R972 Aerosils

| Example No. | CCA[1] | Solvent | Physical State | Charge[2] (μC/g) | Admix Time |
|---|---|---|---|---|---|
| 1 | 3,5-di-tertbutyl-salicylic acid | cyclohexane | adsorption | −82.9 | 2 min |
| 2 | 3,5-di-tertbutyl-salicylic acid | benzene | * | −75.7 | 2 min |
| Comp 1 | 3,5-di-tertbutyl-salicylic acid | methanol | fine particulate mixture | −64.3 | 15 min |
| Comp 5 | 3,5-di-tertbutyl-salicylic acid | acetone | fine particulate mixture | −64.8 | 5–15 min |
| 3 | LR120 | chloroform | adsorption | −51.7 | 30 sec |
| Comp 2 | LR120 | methanol | fine particulate mixture | −56.3 | 1 min |
| Comp 3 | LR120 | heptane/acetone | particulate mixture | −42.3 | ** |
| Comp 6 | LR120 | acetone | fine particulate mixture | −41.0 | 5 min |
| 4 | potassium tetra-phenylborate | chloroform/acetone | adsorption | −94.9 | 2 min |
| Comp 4 | potassium tetra-phenylborate | acetone | fine particulate mixture | −30.9 | 15 min |
| Comp 7 | potassium tetra-phenylborate | acetone | inhomogeneous mixture | −27.3 | 15 min |
| 5[3] | potassium tetra-phenylborate | chloroform/acetone | adsorption | −17.0 | 1 min |
| Comp 8 | potassium tetra-phenylborate | acetone | inhomogeneous mixture | −6.5 | 15 min |

NOTES:
*Mixture of adsorption and fine particulate mixture.
**Due to the charge through problem, the admix time of this sample could not be determined accurately.
[1]Charge control agent
[2]Triboelectric charge
[3]Example 5 and Comparative Example 8 use different toner and developer compositions from the other examples and comparative examples.

What is claimed is:

1. A process for preparing a charge control agent composition comprising solution coating a charge control agent onto flow aid particles until said charge control agent is adsorbed onto said flow aid particles, said solution coating process comprising the steps of:

dissolving said charge control agent in at least one solvent, wherein said charge control agent has a retention time in said solvent, as determined using thin layer chromatography, of less than about 0.5;

adding said flow aid particles to the solvent and forming a suspension of said flow aid particles in said solvent.

2. A process according to claim 1, further comprising the step of removing said solvent from said suspension after adsorption of said charge control agent onto said flow aid particles has occurred.

3. A process according to claim 2, further comprising drying and milling a material remaining after the solvent is removed from the suspension.

4. A process according to claim 1, wherein from about 1 to about 100 parts by weight of said flow aid particles are used for each part by weight of said charge control agent.

5. A process according to claim 4, wherein from about 1 to about 20 parts by weight of said flow aid particles are used for each part by weight of said charge control agent.

6. A process according to claim 1, wherein said charge control agent comprises at least one member selected from the group consisting of 3,5-ditertbutylsalicylic acid, potassium tetraphenylborate, potassium bis(3,5-di-tertbutylsalicylato)borate.

7. A process according to claim 1, wherein said flow aid particles comprise at least one member selected from the group consisting of silica compounds, titanium dioxide, aluminum oxide, tin oxide and magnesium oxide.

8. A process according to claim 1, wherein said solvent comprises at least one member selected from the group consisting of cyclohexane, benzene, methanol, chloroform, heptane, ethyl acetate, hexane, methylene chloride and acetone.

9. A process according to claim 1, wherein said solvent comprises a mixture of chloroform and acetone.

10. A process according to claim 1, wherein said charge control agent is molecularly adsorbed onto said flow aid particles.

11. A process according to claim 1, wherein said charge control agent has a retention time in said solvent, as determined using thin layer chromatography, of less than about 0.2.

* * * * *